US008041040B2

(12) United States Patent
Imaki

(10) Patent No.: US 8,041,040 B2
(45) Date of Patent: Oct. 18, 2011

(54) SOUND IMAGE CONTROL APPARATUS AND SOUND IMAGE CONTROL METHOD

(75) Inventor: Shunsaku Imaki, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1145 days.

(21) Appl. No.: 11/756,082

(22) Filed: May 31, 2007

(65) Prior Publication Data

US 2007/0291949 A1 Dec. 20, 2007

(30) Foreign Application Priority Data

Jun. 14, 2006 (JP) ..... 2006-164884

(51) Int. Cl.
*H04R 5/00* (2006.01)

(52) U.S. Cl. ..... 381/1; 381/18; 381/17

(58) Field of Classification Search ..... 381/1, 18, 381/309, 306, 17, 310, 28
See application file for complete search history.

(56) References Cited

U.S. PATENT DOCUMENTS

| | | | | |
|---|---|---|---|---|
| 4,817,149 | A * | 3/1989 | Myers | 381/1 |
| 5,386,082 | A * | 1/1995 | Higashi | 84/630 |
| 5,581,618 | A | 12/1996 | Satoshi et al. | |
| 5,598,478 | A * | 1/1997 | Tanaka et al. | 381/17 |
| 5,715,317 | A | 2/1998 | Nakazawa | |
| 5,742,688 | A * | 4/1998 | Ogawa et al. | 381/17 |
| 6,370,256 | B1 * | 4/2002 | McGrath | 381/310 |
| 6,763,115 | B1 | 7/2004 | Kobayashi | |
| 2002/0172370 | A1 * | 11/2002 | Ito | 381/18 |
| 2005/0220308 | A1 | 10/2005 | Sekine et al. | |
| 2006/0083394 | A1 * | 4/2006 | McGrath | 381/309 |
| 2008/0056503 | A1 | 3/2008 | McGrath | |

FOREIGN PATENT DOCUMENTS

| | | |
|---|---|---|
| JP | 4-030700 | 2/1992 |
| JP | 5-080755 | 4/1993 |
| JP | 5-300597 | 11/1993 |
| JP | 6-282285 | 10/1994 |
| JP | 7-123498 | 5/1995 |
| JP | 7-298399 | 11/1995 |
| JP | 2005-223646 | 8/2005 |
| JP | 2005-295207 | 10/2005 |
| WO | 2006/039748 | 4/2006 |

OTHER PUBLICATIONS

English language Abstract of JP 7-298399.
Japan Office action, mail date is Feb. 15, 2011.

* cited by examiner

*Primary Examiner* — Vivian Chin
*Assistant Examiner* — Friedrich W Fahnert
(74) *Attorney, Agent, or Firm* — Greenblum & Bernstein, P.L.C.

(57) ABSTRACT

A sound image control apparatus and sound image control method capable of increasing the accuracy, in particular, in the distance direction while keeping fixed intervals of transmission characteristic filters, without increasing the number of the transmission characteristic filters. Sound image control apparatus 100 is provided with distance gain control section 101 that performs gain control of the sound pressure of an input monaural audio signal of one channel in the distance direction from a head to a sound image before input to virtual sound field 1 sound image localization section 120 and virtual sound field 2 sound image localization section 130, and reflected sound gain control section 102 that performs gain control by distance of a reflected sound of the sound pressure of the input monaural audio signal of one channel before input to virtual reflected sound generating section 150 that controls the sound image to be localized outside the head when the sound is listened to with headphones.

10 Claims, 8 Drawing Sheets

CALCULATE REFERENCE ADDRESS FROM MOVE TIME

| [address] | | |
|---|---|---|
| 127 | -50.000 | 0 |
| 126 | -38.588 | -0.103 |
| 125 | -34.151 | -0.172 |
| | ⋮ | ⋮ |
| 102 | -13.979 | -1.938 |
| 101 | -13.645 | -2.024 |
| 100 | -13.324 | -2.110 |
| | ⋮ | ⋮ |
| 27 | -2.067 | -13.483 |
| 26 | -1.981 | -13.811 |
| 25 | -1.896 | -14.151 |
| | ⋮ | ⋮ |
| 2 | -0.137 | -36.090 |
| 1 | -0.068 | -42.110 |
| 0 | 0 | -50.000 |

READ OUT VALUE (GAIN VALUE) OF MEMORY OF REFERENCE ADDRESS AND SET TO PANNING GAIN CONTROL SECTION 140

FIG.4

SOUND IMAGE CONTROL APPARATUS AND SOUND IMAGE CONTROL METHOD

CROSS REFERENCE TO RELATED APPLICATIONS

The disclosure of Japanese Patent Application No. 2006-164884 filed on Jun. 14, 2006 including the specification, drawings and abstract is incorporated herein by reference in its entirety.

BACKGROUND OF THE INVENTION

1. Field of the Invention

The present invention relates to a sound image control apparatus and sound image control method for reproducing a transmission characteristic using a digital filter and convolving the transmission characteristic in an original sound (hereinafter, referred to as a source sound), and thereby controlling sound image localization.

2. Description of Related Art

There is a sound image control apparatus which uses a fact that the transmission characteristic changes due to influence of the shape of head and auricles according to the direction of a sound source position when a human catches a sound, reproduces a transmission characteristic using a digital filter and convolves the transmission characteristic in a source sound, and thereby controls sound image localization.

For example, Patent Document 1 (Japanese Patent Application Laid-Open No. H07-298399) discloses a stereophonic sound listening device holding transmission filters at intervals corresponding to a sound discrimination limit of a human when sound wave transmission characteristics of arrival sounds in respective directions around a head of a listener are reproduced.

FIG. 1 is a block diagram illustrating a configuration of a conventional sound image control apparatus.

In FIG. 1, sound image control apparatus 10 is configured with sound image control section 11, virtual sound field 1 sound image localization section 12, virtual sound field 2 sound image localization section 13, Panning Gain control section 14, virtual reflected sound generating section 15 and localized sound/virtual reflected sound adding section 16.

Panning Gain control section 14 is configured with virtual sound field 1 Rch Panning Gain control section 21, virtual sound field 1 Lch Panning Gain control section 22, virtual sound field 2 Rch Panning Gain control section 23, and virtual sound field 2 Lch Panning Gain control section 24, and localized sound/virtual reflected sound adding section 16 is configured with Rch localized sound/virtual reflected sound adder 25 and Lch localized sound/virtual reflected sound adder 26.

Virtual sound field 1 sound image localization section 12 and virtual sound field 2 sound image localization section 13 control localization to be in an arbitrary position mainly using a transmission characteristic filter (data).

Panning Gain control section 14 performs cross-fade processing on audio signals outputted from virtual sound field 1 sound image localization section 12 and virtual sound field 2 sound image localization section 13.

Sound image control apparatus 10 receives monaural input audio signal 30 as input, and outputs Rch output audio signal 31 and Lch output audio signal 32. Further, "41" is a transmission characteristic filter transfer system to virtual sound field 1 sound image localization section 12, and "42" is a transmission characteristic filter transfer system to virtual sound field 2 sound image localization section 13.

Sound image control section 11 outputs virtual sound field 1 Panning Gain control section control signal 43 to virtual sound field 1 Rch Panning Gain control section 21 and virtual sound field 1 Lch Panning Gain control section 22, and further outputs virtual sound field 2 Panning Gain control section control signal 44 to virtual sound field 2 Rch Panning Gain control section 23 and virtual sound field 2 Lch Panning Gain control section 24.

Virtual sound field 1 Rch Panning Gain control section 21, virtual sound field 1 Lch Panning Gain control section 22, virtual sound field 2 Rch Panning Gain control section 23 and virtual sound field 2 Lch Panning Gain control section 24 are controlled in gain by virtual sound field 1 Panning Gain control section control signal 43 and virtual sound field 2 Panning Gain control section control signal 44, and respectively output virtual sound field 1 Rch Panning Gain control section audio signal 45, virtual sound field 1 Lch Panning Gain control section audio signal 46, virtual sound field 2 Rch Panning Gain control section audio signal 47 and virtual sound field 2 Lch Panning Gain control section audio signal 48 to Rch localized sound/virtual reflected sound adder 25 and Lch localized sound/virtual reflected sound adder 26.

Further, virtual reflected sound generating section 15 outputs virtual reflected sound generating section Rch output audio signal 49 and virtual reflected sound generating section Lch output audio signal 50 to Rch localized sound/virtual reflected sound adder 25 and Lch localized sound/virtual reflected sound adder 26, respectively.

Rch localized sound/virtual reflected sound adder 25 adds virtual sound field 1 Rch Panning Gain control section audio signal 45, virtual sound field 2 Rch Panning Gain control section audio signal 47 and virtual reflected sound generating section Rch output audio signal 49, and outputs the result as Rch output audio signal 31.

Lch localized sound/virtual reflected sound adder 26 adds virtual sound field 1 Lch Panning Gain control section audio signal 46, virtual sound field 2 Lch Panning Gain control section audio signal 48 and virtual reflected sound generating section Lch output audio signal 50, and outputs the result as Lch output audio signal 32.

According to the above-described configuration, it is necessary to have transmission characteristic filters at fixed intervals. In order to obtain sound image localization with higher accuracy, it is necessary to have transmission characteristic filters in a larger number of directions, and therefore large amounts of storage areas are required to store a large number of transmission characteristic filters. The apparatus of Patent Document 1 intends to realize the sound image localization with higher accuracy without increasing the data amount so much by preparing the transmission characteristic filters at only intervals corresponding to the sound discrimination limit of a human.

In such a conventional sound image control apparatus, it is expected to reduce the data amount to some extent, but transmission characteristic filters are not prepared at fixed intervals, and therefore the control method becomes complicated when selecting a transmission characteristic filter in the vicinity of a coordinate point of a move destination calculated from a move instruction for controlling the sound image, and there is a problem that the circuit scale of the sound image control section for controlling the sound image increases, and the operation amount increases.

Further, for the distance direction, it is necessary to prepare transmission characteristic filters in all directions for each distance, and therefore, in order to increase the accuracy in the distance direction, transmission characteristic filters corresponding to all directions are required for one distance and there is a problem that an enormous amount of transmission characteristic filters are required.

SUMMARY OF THE INVENTION

It is therefore an object of the present invention to provide a sound image control apparatus and sound image control method capable of increasing accuracy of sound image localization in a distance direction while keeping fixed intervals of transmission characteristic filters, without increasing the number of the transmission characteristic filters.

According to an aspect of the invention, a sound image control apparatus adopts a configuration including: a distance gain control section that performs gain control of a sound pressure of a monaural audio input signal of one channel with respect to a distance direction from a head to a sound image; a sound image localization section that performs sound image localization operation of an elevation angle and azimuth on the audio signal subjected to distance gain control based on parameter data corresponding to a position in which the sound image is localized; a Panning Gain control section that performs cross-fade processing on stereo audio signals of two channels outputted from the sound image localization section and controls the sound pressure; a localized sound/virtual reflected sound adding section that adds an audio signal including localization information outputted from the Panning Gain control section to the stereo audio signals of two channels, respectively, and outputs stereo audio output signals of two channels; and a sound image control section that sets the parameter data and gain values for gain control to the sound image localization section, the distance gain control section and the Panning Gain control section.

According to an aspect of the invention, a sound image control apparatus adopts a configuration including: a distance gain control section that performs gain control of a sound pressure of a monaural audio input signal of one channel with respect to a distance direction from a head to a sound image; a sound image localization section that performs sound image localization operation of an elevation angle and azimuth on the audio signal subjected to distance gain control based on parameter data corresponding to a position in which the sound image is localized; a reflected sound gain control section that performs gain control by distance of a reflected sound of the sound pressure of the monaural audio input signal of one channel; a virtual reflected sound generating section that generates a virtual reflected sound and localizes the sound image outside a head when the sound is listened to with headphones, for the audio signal subjected to reflected sound gain control; a Panning Gain control section that performs cross-fade processing on stereo audio signals of two channels outputted from the sound image localization section and controls the sound pressure; a localized sound/virtual reflected sound adding section that adds an audio signal including localization information outputted from the Panning Gain control section and an audio signal of the virtual reflected sound outputted from the virtual reflected sound generating section to the stereo audio signals of two channels, respectively, and outputs stereo audio output signals of two channels; and a sound image control section that sets the parameter data and gain values for gain control to the sound image localization section, the distance gain control section, the reflected sound gain control section and the Panning Gain control section.

According to another aspect of the invention, a sound image control method includes: a distance gain step of performing gain control of a sound pressure of a monaural audio input signal of one channel with respect to a distance direction from a head to a sound image; a first sound image localization step of performing sound image localization operation on the audio signal subjected to distance gain control based on first parameter data corresponding to a position in which the sound image is localized; a second sound image localization step of performing sound image localization operation on the audio signal subjected to distance gain control based on second parameter data corresponding to the position in which the sound image is localized; a reflected sound gain step of performing gain control by distance of a reflected sound of the sound pressure of the monaural audio input signal of one channel; a virtual reflected sound generating step of generating a virtual reflected sound to localize the sound image outside a head when the sound is listened to with headphones, for the audio signal subjected to reflected sound gain control; a Panning Gain control step of performing cross-fade processing on stereo audio signals of two channels outputted in the first and second sound image localization steps and controlling the sound pressure; and an output step of adding an audio signal including localization information outputted in the Panning Gain control step and an audio signal of the virtual reflected sound outputted in the virtual reflected sound generating step to the stereo audio signals of two channels, respectively, and outputting stereo audio output signals of two channels.

BRIEF DESCRIPTION OF THE DRAWINGS

FIG. 4 shows actual values of a memory of the Panning Gain table in the sound image control apparatus according to the above-described embodiment;

DETAILED DESCRIPTION OF THE PREFERRED EMBODIMENTS

An embodiment of the present invention will be described in detail below with reference to the accompanying drawings.

Figure 2:
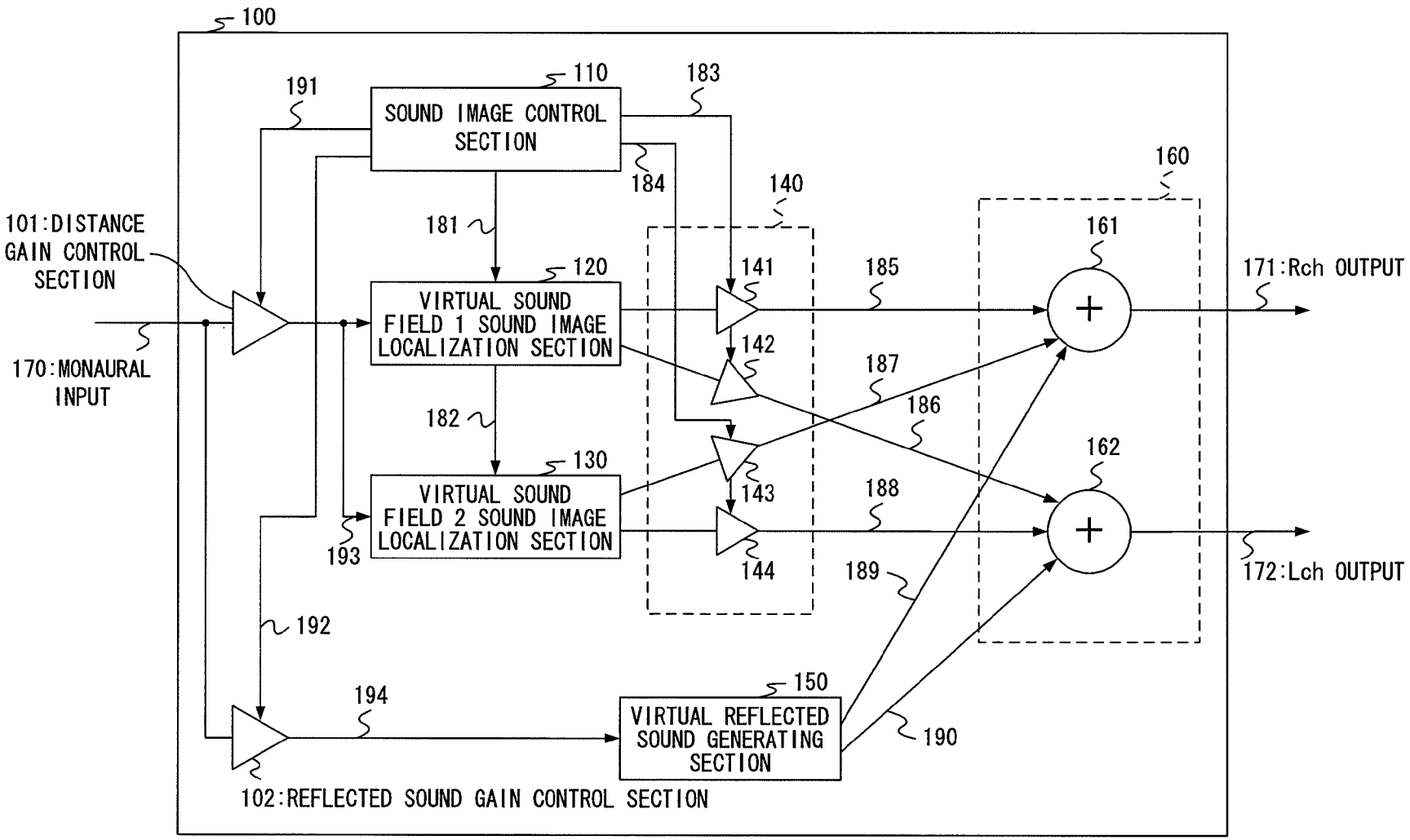
FIG. 2 is a block diagram showing a configuration of a sound image control apparatus according to one embodiment of the present invention.

FIG. 2 is a block diagram showing a configuration of the sound image control apparatus according to one embodiment of the present invention. This embodiment describes an example where the present invention is applied to a sound image control apparatus that localizes a sound image in an arbitrary position around a listener using stereo audio signals of two channels.

In FIG. 2, sound image control apparatus 100 is configured with distance gain control section 101, reflected sound gain control section 102, sound image control section 110, virtual sound field 1 sound image localization section 120, virtual sound field 2 sound image localization section 130, Panning Gain control section 140, virtual reflected sound generating section 150 and localized sound/virtual reflected sound adding section 160.

Panning Gain control section 140 is configured with virtual sound field 1 Rch Panning Gain control section 141, virtual sound field 1 Lch Panning Gain control section 142, virtual sound field 2 Rch Panning Gain control section 143 and virtual sound field 2 Lch Panning Gain control section 144, and localized sound/virtual reflected sound adding section 160 is configured with Rch localized sound/virtual reflected sound adder 161 and Lch localized sound/virtual reflected sound adder 162.

The following signals are inputted and outputted to/from each of the above-described sections.

Sound image control apparatus 100 receives monaural input audio signal 170 as input, and outputs Rch output audio signal 171 and Lch output audio signal 172. Further, "181" is a transmission characteristic filter transfer system to virtual sound field 1 sound image localization section 120, and "182" is a transmission characteristic filter transfer system to virtual sound field 2 sound image localization section 130.

Sound image control section 110 outputs distance gain control section control signal 191 to distance gain control section 101, and reflected sound gain control section control signal 192 to reflected sound gain control section 102. Further, sound image control section 110 outputs virtual sound field 1 Panning Gain control section control signal 183 to virtual sound field 1 Rch Panning Gain control section 141, and virtual sound field 1 Lch Panning Gain control section 142, while outputting virtual sound field 2 Panning Gain control section control signal 184 to virtual sound field 2 Rch Panning Gain control section 143 and virtual sound field 2 Lch Panning Gain control section 144.

Distance gain control section 101 outputs distance gain control section output audio signal 193 to virtual sound field 1 sound image localization section 120, and virtual sound field 2 sound image localization section 130, and reflected sound gain control section 102 outputs reflected sound gain control section output audio signal 194 to virtual reflected sound generating section 150.

Virtual sound field 1 Rch Panning Gain control section 141, virtual sound field 1 Lch Panning Gain control section 142, virtual sound field 2 Rch Panning Gain control section 143 and virtual sound field 2 Lch Panning Gain control section 144 are controlled in gain by virtual sound field 1 Panning Gain control section control signal 183 and virtual sound field 2 Panning Gain control section control signal 184, and respectively output virtual sound field 1 Rch Panning Gain control section audio signal 185, virtual sound field 1 Lch Panning Gain control section audio signal 186, virtual sound field 2 Rch Panning Gain control section audio signal 187 and virtual sound field 2 Lch Panning Gain control section audio signal 188 to Rch localized sound/virtual reflected sound adder 161 and Lch localized sound/virtual reflected sound adder 162.

Further, virtual reflected sound generating section 150 outputs virtual reflected sound generating section Rch output audio signal 189 and virtual reflected sound generating section Lch output audio signal 190 to Rch localized sound/virtual reflected sound adder 166 and Lch localized sound/virtual reflected sound adder 162.

Rch localized sound/virtual reflected sound adder 161 adds virtual sound field 1 Rch Panning Gain control section audio signal 185, virtual sound field 2 Rch Panning Gain control section audio signal 187 and virtual reflected sound generating section Rch output audio signal 189, and outputs the result as Rch output audio signal 171.

Lch localized sound/virtual reflected sound adder 162 adds virtual sound field 1 Lch Panning Gain control section audio signal 186, virtual sound field 2 Lch Panning Gain control section audio signal 188 and virtual reflected sound generating section Lch output audio signal 190, and outputs the result as Lch output audio signal 172.

Distance gain control section 101 performs gain control of a sound pressure of an inputted monaural audio signal of one channel for a distance direction from a head to a sound image, and outputs distance gain control section output audio signal 193 subjected to distance gain control to virtual sound field 1 sound image localization section 120 and virtual sound field 2 sound image localization section 130.

Reflected sound gain control section 102 performs gain control by distance of a reflected sound of the sound pressure of the inputted monaural audio signal of one channel, and outputs reflected sound gain control section output audio signal 194 subjected to reflected sound gain control to virtual reflected sound generating section 150.

Sound image control section 110 sets first parameter data for localizing a sound image in a given position to virtual sound field 1 sound image localization section 120, sets second parameter data for localizing a sound image in a position that is the same or different as/from the given position to virtual sound field 2 sound image localization section 130, and sets predetermined gain values to distance gain control section 101, Panning Gain control section 140 and reflected sound gain control section 102.

Further, sound image control section 110 has distance gain table 210 (see FIGS. 5 and 7) to refer to a gain value set at a given distance upon changing the sound pressure according to the distance, reflected sound gain table 220 (see FIGS. 6 and 7) to refer to a gain value set at a given distance upon changing the sound pressure according to the distance, and Panning Gain table 200 (see FIGS. 3 and 4) to refer to a gain value set at a given move time upon changing the sound pressure according to the move time, and sets gain characteristics in accordance with characteristics of a virtual sound field to distance gain table 210, reflected sound gain table 220 and Panning Gain table 200.

Sound image control section 110 sets the move time upon move from a starting point to an endpoint and distances to the starting point and the endpoint, refers to distance gain table 210, reflected sound gain table 220 and Panning Gain table 200, and thereby automatically sets, for each unit of time, gain values corresponding to the move elapsed time and the move distance at the time, to distance gain control section 101, reflected sound gain control section 102 and Panning Gain control section 140.

Virtual sound field 1 sound image localization section 120 and virtual sound field 2 sound image localization section 130 are sound image localization sections for localizing a sound image in an arbitrary position around a listener using stereo audio signals of two channels, set parameter data corresponding to the position in which the sound image is localized, and based on the set parameter data, perform sound image localization operation of an elevation angle and azimuth on the inputted monaural audio signal of one channel.

Panning Gain control section 140 performs cross-fade processing on audio signals outputted from virtual sound field 1 sound image localization section 120 and virtual sound field 2 sound image localization section 130, and controls sound pressures of stereo audio signals of two channels outputted from virtual sound field 1 sound image localization section 120 and virtual sound field 2 sound image localization section 130.

Virtual reflected sound generating section 150 generates a virtual reflected sound for localizing a sound image outside the head when the sound is listened to with headphones.

Thus, sound image control apparatus 100 has distance gain control section 101 that performs gain control in the distance direction, before input to virtual sound field 1 sound image localization section 120 and virtual sound field 2 sound image localization section 130 that control the elevation angle and azimuth through transmission characteristic filter processing, and also has reflected sound gain control section 102 that performs gain control by distance of a reflected sound, before input to virtual reflected sound generating section 150 for controlling the sound image to be localized outside the head when the sound is listened to with headphones, and thereby performs gain control relating to the distance independently of the transmission characteristic filter processing.

Figure 3:
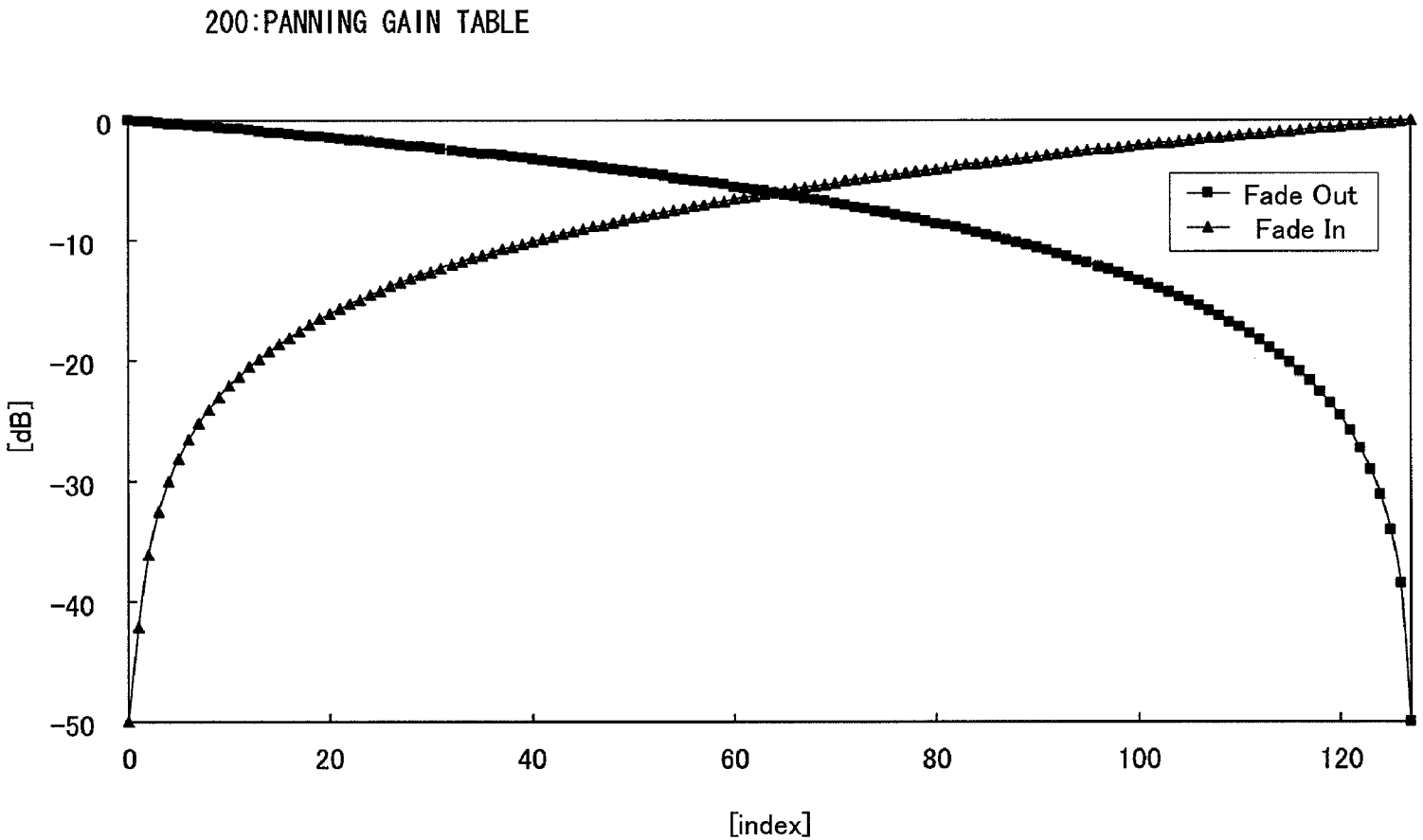
FIG. 3 shows an example of a Panning Gain table in the sound image control apparatus according to the above-described embodiment.

FIG. 3 shows an example of above-described Panning Gain table 200. The horizontal axis indicates index [index] which is a reference address, and the vertical axis indicates gain [dB]. Panning Gain table 200 has two table values: Fade Out table value (see sign ■) and Fade In table value (see sign ▲) for performing the cross-fade processing of an audio signal. Sign points in the figure indicate values actually held in the table.

Figure 1:
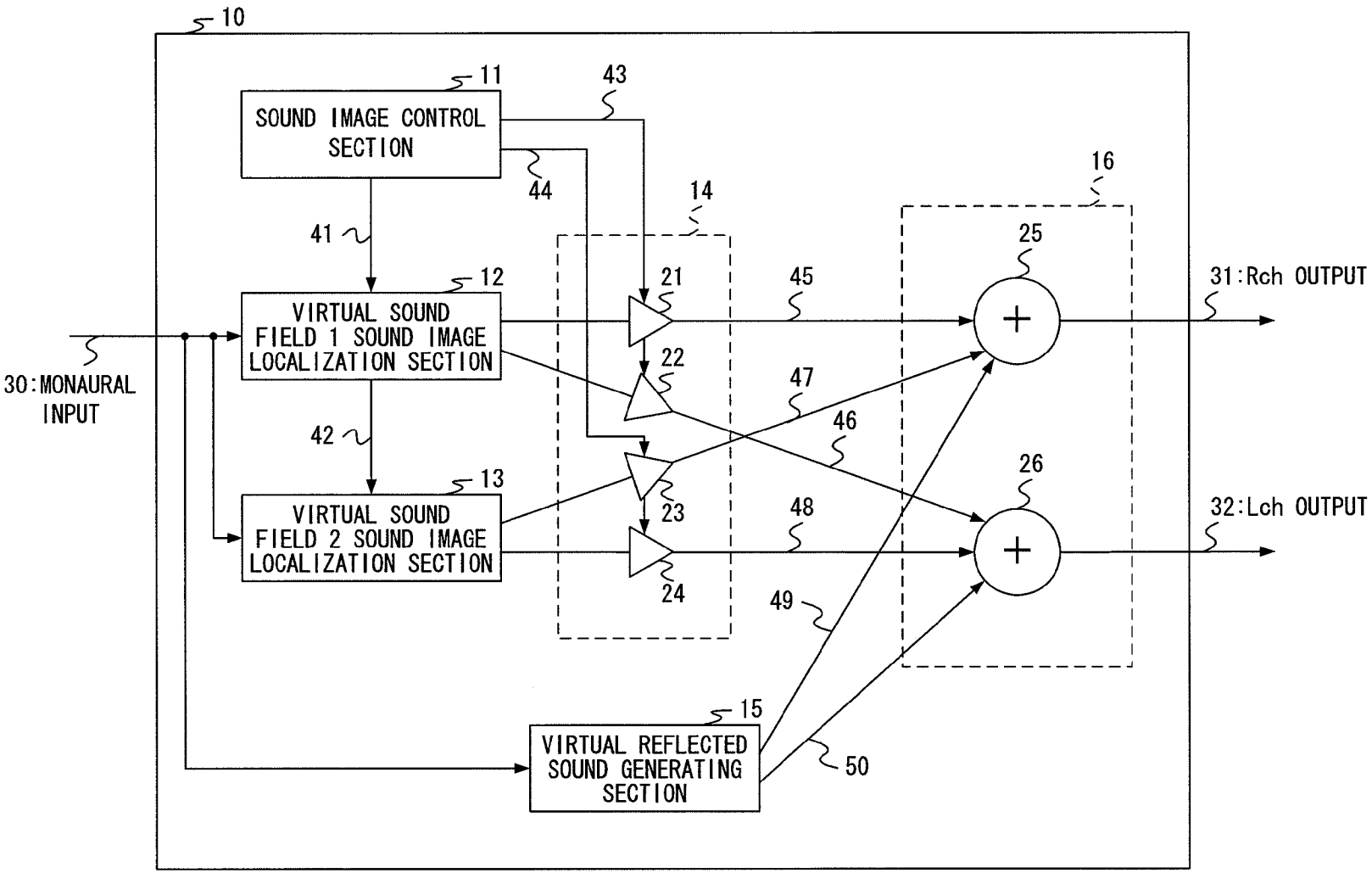
FIG. 1 is a block diagram showing a configuration of a conventional sound image control apparatus.

FIG. 4 shows actual values (gain values) of a memory of Panning Gain table 200 of FIG. 3. In FIG. 4, Panning Gain table 200 stores Fade Out and Fade In table values corresponding to reference addresses 0-127[address]. The reference operation of Panning Gain table 200 is as described below. Sound image control section 110 calculates a reference address from the move time, reads out values (gain values) of the memory of the corresponding reference address by referring to Panning Gain table 200 of FIG. 4, and sets the read out gain values to Panning Gain control section 140. For example, when reference address "26" is calculated from the move time, sound image control section 110 reads out Fade In gain value "−1.981" and Fade Out gain value "−13.811" corresponding to reference address "26" and sets the values to Panning Gain control section 140. In addition, also in the conventional example, the cross-fade processing of an audio signal using the Panning Gain table as described above is performed at Panning Gain control section 14 as shown in FIG. 1.

Figure 5:
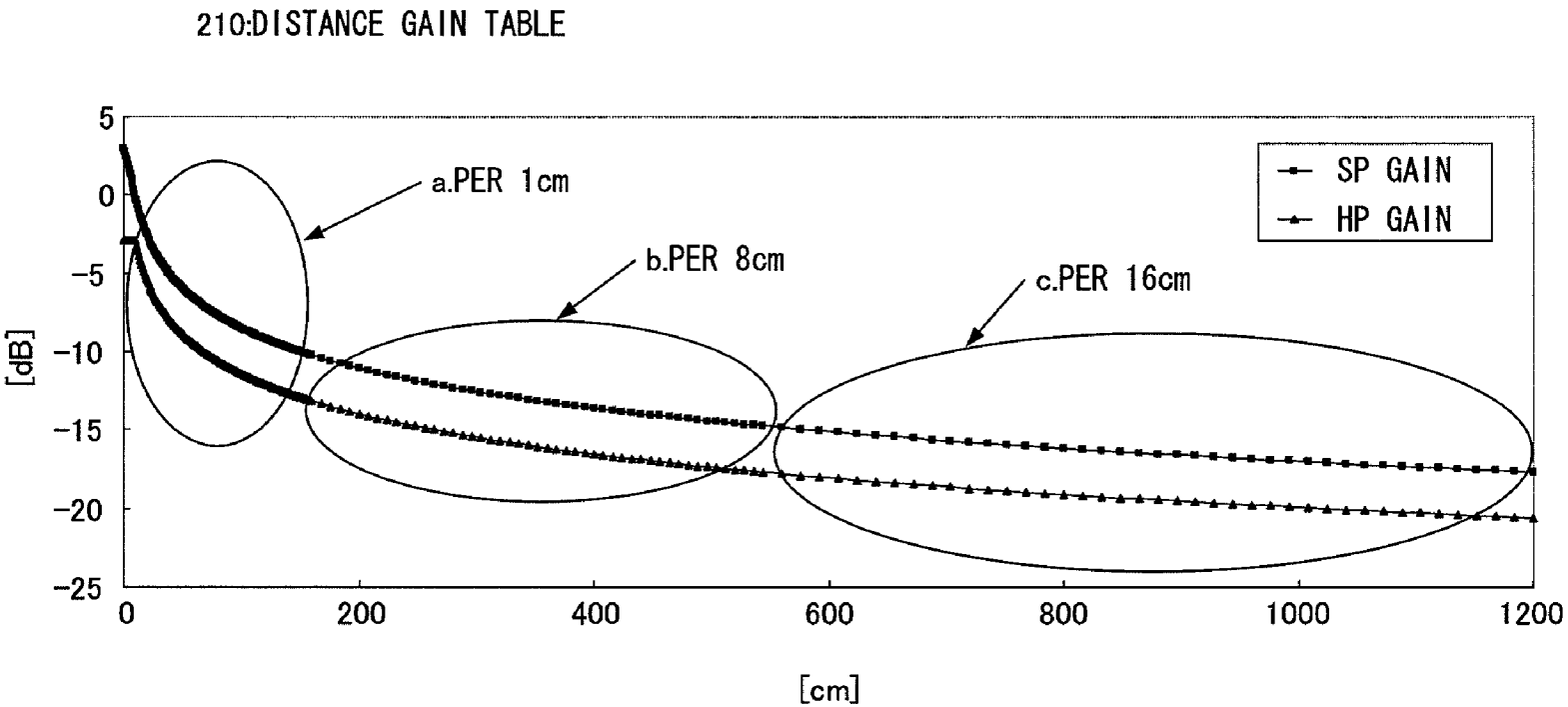
FIG. 5 shows an example of a distance gain table in the sound image control apparatus according to the above-described embodiment.

FIG. 5 shows an example of above-described distance gain table 210. The horizontal axis indicates a distance [cm] from the head, and the vertical axis indicates gain [dB]. Distance gain table 210 has two table values; SP gain value (see sign ■) and HP gain value (see sign ▲) In this embodiment, distance gain table 210 has two gain values, but may have three or more values for changing the sensitivity according to specifications. Sign points in the figure indicate values actually held in the table. As shown in FIG. 5, a change amount of gain changes largely in accordance with the distance (the change amount is larger when the distance is short), and therefore three regions are provided according to the distance, and by changing the interval of stored table values for each of three regions, the capacity of the gain table is reduced. In this embodiment, the table values are stored at intervals of 1 cm in region a. where the change amount is the largest with respect to the distance, at intervals of 8 cm in region b. where the change amount is the second largest with respect to the distance, and at intervals of 16 cm in region c. where the change amount is small with respect to the distance.

Figure 6:
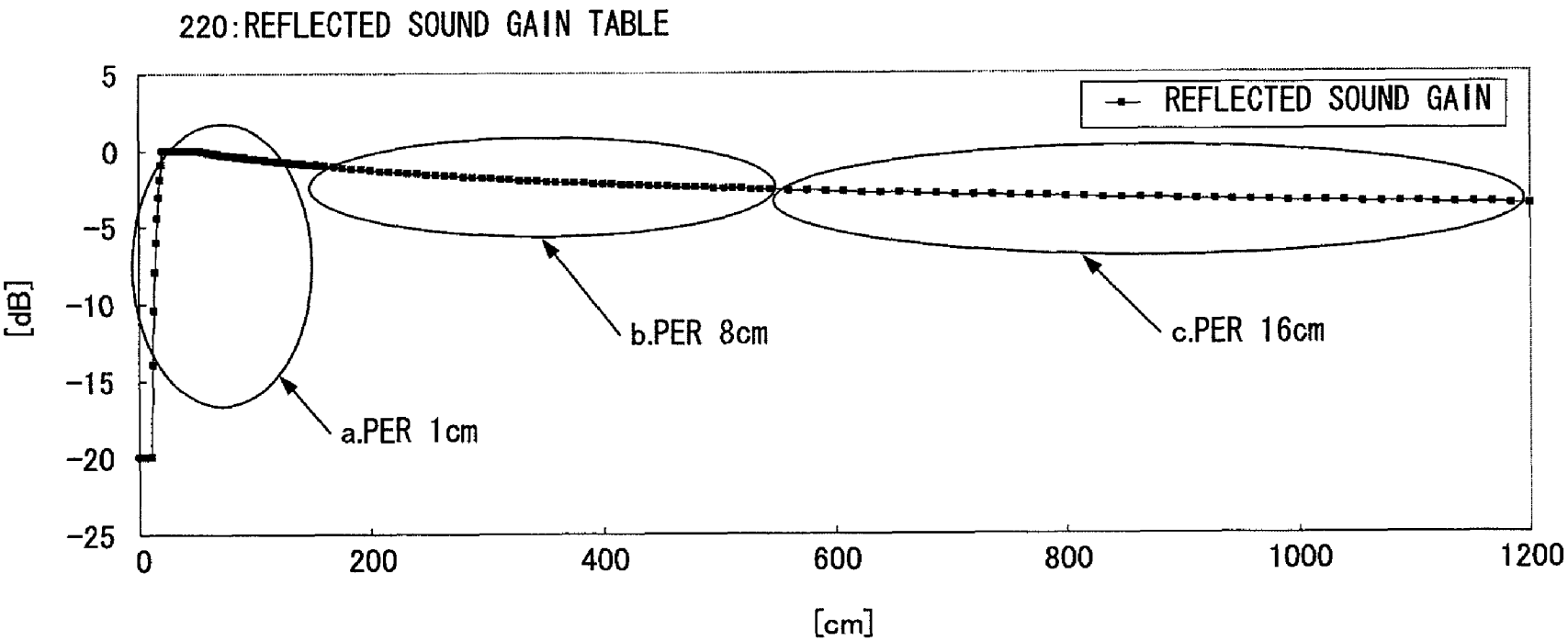
FIG. 6 shows an example of a reflected sound gain table in the sound image control apparatus according to the above-described embodiment.

FIG. 6 shows an example of above-described reflected sound gain table 220. The horizontal axis indicates a distance [cm] from a head, and the vertical axis indicates gain [dB]. Sign points (see sign ■) in the figure indicate values actually held in the table. As shown in FIG. 6, the change amount of gain changes largely in accordance with the distance (the change amount is large when the distance is short) also in reflected sound gain table 220, three regions are provided according to the distance, and by changing the interval of the stored table values for each of three regions, the capacity of the gain table is reduced. In this embodiment, the table values are stored at intervals of 1 cm in region a. where the change amount is the largest with respect to the distance, at intervals of 8 cm in region b. where the change amount is the second largest with respect to the distance, and at intervals of 16 cm in region c. where the change amount is small with respect to the distance.

Figure 7:
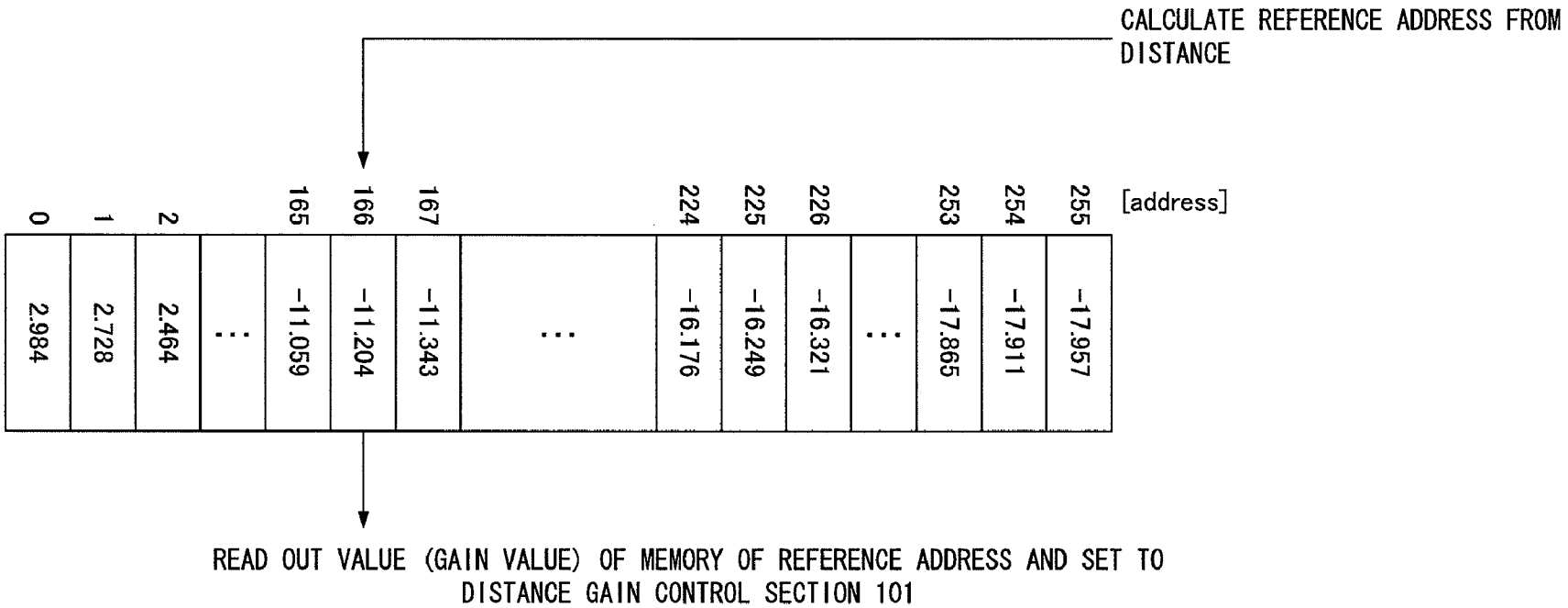
FIG. 7 shows actual values of a memory of the distance gain table in the sound image control apparatus according to the above-described embodiment.

FIG. 7 shows actual values (gain values) of the memory of distance gain table 210 of FIG. 5. Herein, the case of HP gain value is adopted as an example, but it is the same for the cases of SP gain value and reflected sound gain value in reflected sound gain table 220 in FIG. 6. In FIG. 7, distance gain table 210 stores table values corresponding to reference addresses 0-255[address]. The reference operation for distance gain table 210 (that is the same as for reflected sound gain table 220) is as described below. Sound image control section 110 calculates a reference address from the distance, reads out a value (gain value) of the memory of the corresponding reference address by referring to above-described distance gain table 210 (reflected sound gain table 220), and sets the read out gain value to distance gain control section 101 (reflected sound gain control section 102). For example, when reference address "166" is calculated from the distance, sound image control section 110 reads out gain value "−11.204" corresponding to reference address "166" and sets the gain value to distance gain control section 101 (reflected sound gain control section 102).

The operation of the sound image control apparatus configured as described above will be described.

First, filter coefficients set to virtual sound field 1 sound image localization section 120 and virtual sound field 2 sound image localization section 130 will be described.

Figure 8:
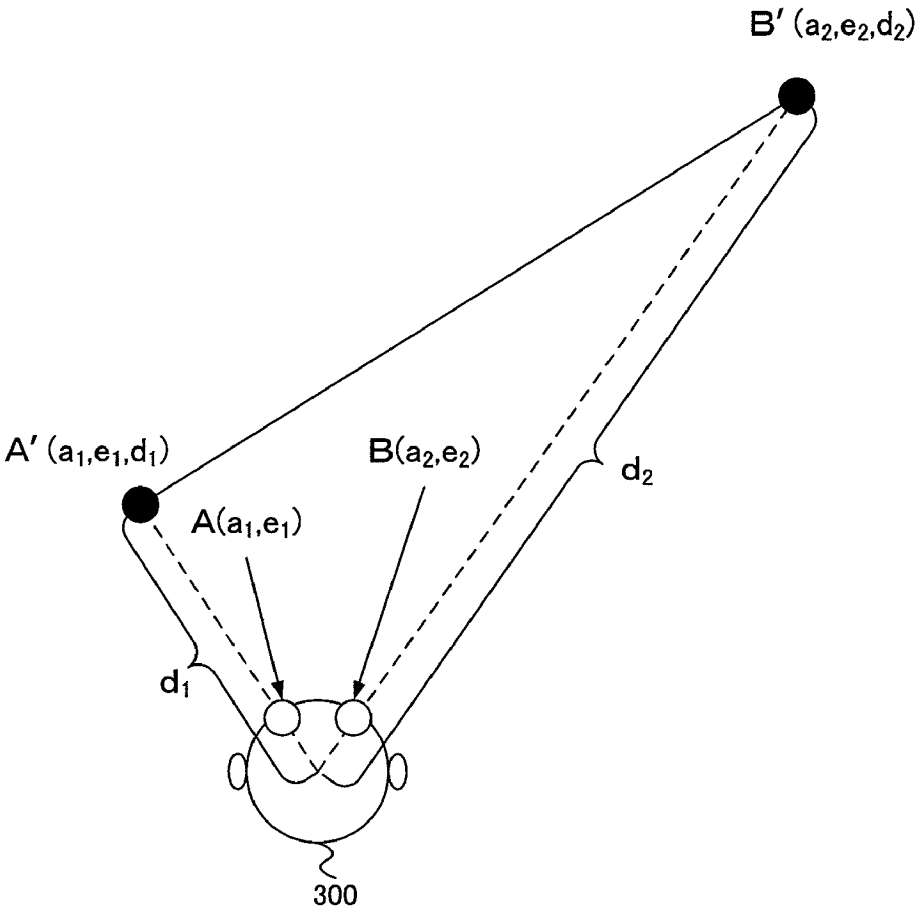
FIG. 8 illustrates move of a sound image in the sound image control apparatus according to the above-described embodiment.

FIG. 8 illustrates move of a sound image.

In FIG. 8, point A of the sound image with an azimuthal angle (angle) and elevation angle (elevation) of $(a_1, e_1)$ exists ahead of head 300 on the left, and point B of the sound image with an azimuthal angle and elevation angle of $(a_2, e_2)$ exists ahead of head 300 on the right. Using filter coefficients calculated from the azimuthal angle and elevation angle (not dependent on the distance), the filter coefficients at point A and point B are respectively set to virtual sound field 1 sound image localization section 120 and virtual sound field 2 sound image localization section 130. Further, sound images indicating actual sound images are assumed to be A' $(a_1, e_1, d_1)$ and B' $(a_2, e_2, d_2)$. In this embodiment, distance $d_1$ of point A' and distance $d_2$ of point B' which are distance information indicating the distance from head 300 are newly added. Distance gain control section 101 refers to distance gain table 210 to control distance $d_1$ of point A' and distance $d_2$ of point B' independently of the azimuthal angle and elevation angle, and thereby can control a move of the sound image from point A' to point B'. As a more specific effect, by focusing on the fact that differences between transmission characteristic filters in the distance direction mostly come from gain components and introducing the distance (information) from head 300 to a move of the sound image, it is possible to perform control in the distance direction by independent gain control, and by only holding transmission characteristic filters corresponding to elevation angles and azimuths at fixed intervals with respect to one distance, it is possible to implement localization of a sound image with high accuracy also in the distance direction. Herein, it is preferable that the filter coefficients do not depend on the distance, and therefore the distance of a size (about 10 to 15 cm) of head 300 is preferably used as a reference.

Referring to FIG. 2 again, the above-described filer coefficients are set to virtual sound field 1 sound image localization section 120 and virtual sound field 2 sound image localization section 130, and as in the conventional example, control is performed on the elevation angle and azimuth through the transmission characteristic filter processing. In this embodiment, distance gain control section 101 that performs gain control in the distance direction is provided before input to virtual sound field 1 sound image localization section 120 and virtual sound field 2 sound image localization section 130, and, first, virtual sound field 1 sound image localization section 120 and virtual sound field 2 sound image localization section 130 perform sound image localization control through sound image localization operation on the monaural input audio signal of one channel subjected to gain control by distance gain control section 101. Further, in this embodiment, reflected sound gain control section 102 that performs gain control by distance of a reflected sound is provided before input to virtual reflected sound generating section 150, and the reflected sound is also subjected to gain control by distance as in the case of the above-described sound image localization.

First, monaural input audio signal 170 of one channel is inputted to distance gain control section 101 and reflected sound gain control section 102.

Upon receiving monaural input audio signal 170 of one channel, distance gain control section 101 refers to distance gain table 210 (FIG. 5) internally stored in sound image control section 110, and reads out a distance gain value corresponding to the distance information at the current moment. The operation for distance gain table 210 is as described in FIG. 7. By distance gain control section 101, it is possible to control the sound pressure of monaural input audio signal 170 to be the distance gain value, and perform control of the sound image in the distance direction.

Similarly, when monaural input audio signal 170 of one channel is inputted, reflected sound gain control section 102 refers to reflected sound gain table 220 (FIG. 6) internally stored in sound image control section 110, and reads out a reflected sound gain value corresponding to the distance information at the current moment. By controlling the sound pressure of the virtual reflected sound according to the distance when the sound is listened to with headphones by reflected sound gain control section 102, it is possible to control outside-head localization.

Virtual sound field 1 sound image localization section 120 and virtual sound field 2 sound image localization section 130 perform sound image localization operation using transmission characteristic filters on the monaural input audio signal controlled to be the distance gain value by distance gain control section 101, and localize a sound image in an arbitrary position around a listener.

Panning Gain control section 140 refers to Panning Gain table 200 (FIG. 3) internally stored in sound image control section 110, and sets Panning Gain values corresponding to the Panning information at the current moment to virtual sound field 1 Rch Panning Gain control section 141, virtual sound field 1 Lch Panning Gain control section 142, virtual sound field 2 Rch Panning Gain control section 143 and virtual sound field 2 Lch Panning Gain control section 144. Based on the set Panning Gain values, virtual sound field 1 Rch Panning Gain control section 141, virtual sound field 1 Lch Panning Gain control section 142, virtual sound field 2 Rch Panning Gain control section 143 and virtual sound field 2 Lch Panning Gain control section 144 perform the cross-fade processing on the audio signal outputted from virtual sound field 1 sound image localization section 120 and virtual sound field 2 sound image localization section 130.

Meanwhile, reflected sound gain control section 102 outputs to virtual reflected sound generating section 150 reflected sound gain control section output audio signal 194 controlled to be the sound pressure of the virtual reflected sound according to the distance when the sound is listened to with headphones. Based on reflected sound gain control section output audio signal 194, virtual reflected sound generating section 150 generates a virtual reflected sound by an acoustic characteristic filter of a given space and controls outside-head localization when the sound is listened to with headphones.

Rch localized sound/virtual reflected sound adder 161 and Lch localized sound/virtual reflected sound adder 162 of localized sound/virtual reflected sound adder 160 add the audio signal including localization information outputted from Panning Gain control section 140 and the audio signal of the virtual reflected sound outputted from virtual reflected sound generating section 150 in Rch and Lch, respectively and thereby output Rch output audio signal 171 and Lch output audio signal 172.

The above-described operation is as described below in terms of control steps.

(1) a distance gain step of performing gain control of a sound pressure of a monaural audio input signal of one channel for a distance direction from a head to a sound image;

(2) a first sound image localization step of performing sound image localization operation on the audio signal subjected to distance gain control based on first parameter data corresponding to a position in which the sound image is localized;

(3) a second sound image localization step of performing sound image localization operation on the audio signal subjected to distance gain control based on second parameter data corresponding to the position in which the sound image is localized;

(4) a reflected sound gain step of performing gain control by distance of a reflected sound of the sound pressure of the monaural audio input signal of one channel;

(5) a virtual reflected sound generating step of generating a virtual reflected sound to localize the sound image outside a head when the sound is listened to with headphones, using the audio signal subjected to reflected sound gain control;

(6) a Panning Gain control step of performing cross-fade processing on stereo audio signals of two channels outputted in the first and second sound image localization steps and controlling the sound pressure; and (7) an output step of adding the audio signal including localization information outputted in the Panning Gain control step and an audio signal of the virtual reflected sound outputted in the virtual reflected sound generating step to the stereo audio signals of two channels, respectively and outputting stereo audio output signals of two channels. By executing the above steps, the sound image is localized in an arbitrary position around a listener using the stereo audio signals of two channels.

For the above-described first sound image localization step, second sound image localization step, distance gain control step, reflected sound gain control step and Panning Gain control step, a sound image control step is executed as appropriate for setting first parameter data, second parameter data and gain values for gain control.

As specifically described above, according to this embodiment, sound image control apparatus 100 is provided with: distance gain control section 101 that performs gain control of the sound pressure of an inputted monaural audio signal of one channel for the distance direction from a head to a sound image before input to virtual sound field 1 sound image localization section 120 and virtual sound field 2 sound image localization section 130; and reflected sound gain control section 102 that performs gain control by distance of a reflected sound of the sound pressure of the inputted monaural audio signal of one channel before input to virtual reflected sound generating section 150 for controlling the sound image to be localized outside the head when the sound is listened to with headphones, so that it is possible to perform the gain control for the distance independently of the transmission characteristic filter processing. By this means, distance gain control section 101 first performs control in the distance direction by independent gain control, and then, sound image localization sections 120 and 130 perform sound image localization operation for localizing a sound image on the audio signal subjected to gain control in the distance. Similarly, for virtual reflected sound generating section 150, reflected sound gain control section 102 first performs gain control by the distance on the reflected sound, and then, for the audio signal subjected to reflected sound gain control, virtual reflected sound generating section 150 controls the sound image to be localized outside the head. Accordingly, as compared with the conventional example of simply reproducing the transmission characteristic using a digital filter without distinguishing the distance direction, in this embodiment, by substituting gain control for sound image localization operation using transmission characteristic filters for the distance direction, it is possible to substantially reduce the operation amount or the number of transmission characteristic filters while ensuring the accuracy of the sound image localization. As a specific effect, control in the distance direction can be performed by independent gain control, and therefore by holding transmission characteristic filters corresponding to elevation angles and azimuths at fixed intervals with respect to one distance, it is possible to implement the sound image localization image with high accuracy also in the distance direction. Further, unlike the apparatus as described in Patent Document 1, it is not necessary to reduce the transmission characteristic filters by making intervals of the prepared transmission characteristic filters uneven for reducing the transmission characteristic filters. Therefore, according to this embodiment, it is possible to simplify the control method such as in selecting a transmission characteristic filter, and reduce the circuit scale and operation amount of sound image control section 110 for sound image control.

Thus, by enabling the gain control for the distance to be performed independently of the transmission characteristic filter processing, it is possible to increase the accuracy in particular in the distance direction while keeping fixed intervals of transmission characteristic filters, without increasing the number of the transmission characteristic filters.

The above-described explanation is an example of a preferred embodiment of the present invention, and the scope of the invention is not limited to this. For example, the present invention can be implemented with an apparatus not having reflected sound gain control section 102 and virtual reflected sound generating section 150.

Further, this embodiment describes the example where the present invention is applied to a sound image control apparatus of audio signals, but the present invention can be applied to similar other sound image control apparatuses.

Furthermore, tables and other diagrams in FIGS. 3 to 8 are examples, and may be of data structure.

Still furthermore, this embodiment uses the title of the sound image control apparatus and sound image control method for convenience in description, but naturally, other titles are available such as a sound apparatus, sound reproducing system, sound image localization method and the like.

Moreover, types of circuit sections, for example, signal processing sections, configuring the above-described sound image control apparatus, the number of channels, connection methods and the like are not limited to the embodiment as described above.

As described above, according to the present invention, by focusing on the fact that differences between transmission characteristic filters in the distance direction mostly come from gain components and enabling control in the distance direction to be performed by independent gain control, it is possible to implement sound image localization with high accuracy in the distance direction only by holding transmission characteristic filters corresponding to elevation angles and azimuths at fixed intervals with respect to one distance.

Accordingly, with the sound image control apparatus and sound image control method according to the present invention, by enabling the gain control in sound image localization in the distance direction to be performed independently of the transmission characteristic filter processing, it is possible to increase the accuracy, in particular in the distance direction while keeping fixed intervals of transmission characteristic filters, without increasing the number of the transmission characteristic filters, and the sound image control apparatus and sound image control method are useful as a sound image control apparatus and the like of a mobile equipment and the like, and can be applied to use of a game apparatus and the like.

What is claimed is:

1. A sound image control apparatus, comprising:

a distance gain controller that performs a gain control of a sound pressure of a monaural audio input signal of one channel with respect to a distance direction from a head to a sound image;

a first sound image localizer that performs a sound image localization operation of an elevation angle and azimuth on the monaural audio signal of one channel subjected to the gain control in the distance gain controller, based on first parameter data corresponding to a position in which the sound image is localized, and outputs a first stereo audio signal of two channels in a first virtual sound field;

a second sound image localizer that performs a sound image localization operation of an elevation angle and azimuth on the monaural audio signal of one channel subjected to the gain control in the distance gain control section, based on second parameter data corresponding to a position in which the sound image is localized, and outputs a second stereo audio signal of two channels in a second virtual sound field;

a Panning Gain controller that performs cross-fade processing on the first and second stereo audio signals of two channels outputted from the first and second sound image localizers and performs gain control of a sound pressure of the first and second stereo audio signals of two channels;

a localized sound/virtual reflected sound adder that generates a stereo audio output signal of two channels by adding, per channel, the first and second stereo audio signals of two channels subjected to the gain control in the Panning Gain controller; and a sound image controller that sets a first gain value to be used in the gain control in the distance gain controller, the first parameter data to be used in the first sound image localizer, the second parameter data to be used in the second sound image localizer, and a second gain value to be used in the gain control in the Panning Gain controller.

2. A sound image control apparatus, comprising:

a distance gain controller that performs a gain control of a sound pressure of a monaural audio input signal of one channel with respect to a distance direction from a head to a sound image;

a first sound image localizer that performs a sound image localization operation of an elevation angle and azimuth on the monaural audio signal of one channel subjected to the gain control in the distance gain controller, based on first parameter data corresponding to a position in which the sound image is localized, and outputs a first stereo audio signal of two channels in a first virtual sound field;

a second sound image localizer that performs a sound image localization operation of an elevation angle and azimuth on the monaural audio signal of one channel subjected to the gain control in the distance gain controller, based on second parameter data corresponding to a position in which the sound image is localized, and outputs a second stereo audio signal of two channels in a second virtual sound field;

a reflected sound gain controller that performs a gain control based upon a distance of a reflected sound of the sound pressure of the monaural audio input signal of one channel;

a virtual reflected sound generator that generates a virtual reflected sound and localizes the sound image outside a head when the sound is listened to with headphones, for the monaural audio signal of one channel subjected to the gain control in the reflected sound gain controller, and outputs a stereo audio signal of two channels of the virtual reflected sound;

a Panning Gain controller that performs cross-fade processing on the first and second stereo audio signals of two channels outputted from the first and second sound image localizers and performs a gain control of a sound pressure of the first and second stereo audio signals of two channels;

a localized sound/virtual reflected sound adder that generates a stereo audio output signal of two channels by adding, per channel, the first and second stereo audio signals of two channels subjected to the gain control in the Panning Gain controller, and the stereo audio signal of two channels of the virtual reflected sound outputted from the virtual reflected sound generator; and a sound image controller that sets a first gain value to be used in the gain control in the distance gain controller, the first parameter data to be used in the first sound image localizer, the second parameter data to be used in the second sound image localizer, a second gain value to be used in the gain control in the Panning Gain controller, and a third gain value to be used in the gain control in the reflected sound gain controller.

3. The sound image control apparatus according to claim 1, wherein the sound image localizer comprises:

a first virtual sound field sound image localizer that performs a sound image localization operation based on first parameter data to localize the sound image in a first virtual sound field; and a second virtual sound field sound image localizer that performs a sound image localization operation based on second parameter data to localize the sound image in a second virtual sound field.

4. The sound image control apparatus according to claim 3, wherein the sound image controller sets the first parameter data to localize the sound image in a given position to the first virtual sound field sound image localizer, and sets the second parameter to localize the sound image in a position that is the same as the given position or different from the given position to the second virtual sound field sound image localizer.

5. The sound image control apparatus according to claim 1, wherein the sound image controller comprises a distance gain table to refer to a gain value to set in a given distance upon changing the sound pressure according to the distance, and sets the referred gain value to the distance gain controller.

6. The sound image control apparatus according to claim 2, wherein the sound image controller comprises a reflected sound gain table to refer to a gain value to set in a given distance upon changing the sound pressure according to the distance, and sets the referred gain value to the reflected sound gain controller.

7. The sound image control apparatus according to claim 1, wherein the sound image comprises a Panning Gain table to refer to a gain value to set in a given move time upon changing the sound pressure according to the move time, and sets the referred gain value to the Panning Gain controller.

8. The sound image control apparatus according to claim 2, wherein:

the sound image controller comprises:

a distance gain table to refer to a gain value to set in a given distance upon changing the sound pressure according to the distance;

a reflected sound gain table to refer to a gain value to set in a given distance upon changing the sound pressure according to the distance; and a Panning Gain table to refer to a gain value to set in a given move time upon changing the sound pressure according to a move time; and the sound image controller sets the move time upon a move from a starting point to an endpoint and distances to the starting point and the endpoint, refers to the distance gain table, the reflected sound gain table and the Panning Gain table, and thereby sets, for each unit of time, gain values corresponding to a move elapsed time and a move distance at the time to the distance gain controller, the reflected sound gain controller and the Panning Gain controller.

9. A sound image control method, comprising:

performing a first gain control of a sound pressure of a monaural audio input signal of one channel with respect to a distance direction from a head to a sound image;

performing a first sound image localization operation on the monaural audio signal of one channel subjected to the first performed gain control, based on first parameter data corresponding to a position in which the sound image is localized, and outputting a first stereo audio signal of two channels in a first virtual sound field;

performing a second sound image localization operation on the monaural audio signal of one channel subjected to the first performed gain control, based on second parameter data corresponding to the position in which the sound image is localized, and outputting a second stereo audio signal of two channels in a second virtual sound field;

performing a second gain control by distance of a reflected sound of the sound pressure of the monaural audio input signal of one channel;

generating a virtual reflected sound to localize the sound image outside a head when the sound is listened to with headphones, for the monaural audio signal of one channel subjected to the second performed gain control, and outputting a stereo audio signal of two channels of the virtual reflected sound;

performing cross-fade processing on the outputted first and second stereo audio signals of two channels and performing a third gain control of a sound pressure of the first and second stereo audio signals of two channels;

generating a stereo audio output signal of two channels by adding, per channel, the first and second stereo audio signals of two channels subjected to the third gain control, and the outputted stereo audio signal of two channels of the virtual reflected sound; and setting a first gain value to be used in the first gain control, the first parameter data to be used in the performed first sound image localization operation, the second parameter data to be used in the performed second sound image localization operation, a second gain value to be used in the third gain control, and a third gain value to be used in the performed second gain control.

10. The sound image control method according to claim 9, further comprising:

setting the first parameter data, the second parameter data and gain values for gain control to the first sound image localization operation, the second sound image localization operation, the performed first gain control, the second gain control and the cross-fade processing.

* * * * *